United States Patent [19]

Thomerson

[11] Patent Number: 4,543,998

[45] Date of Patent: Oct. 1, 1985

[54] PROTECTOR CLAMP FOR WELL CONTROL LINES

[75] Inventor: Clarence Thomerson, Corsicana, Tex.

[73] Assignee: Regal International, Inc., Corsicana, Tex.

[21] Appl. No.: 552,806

[22] Filed: Nov. 17, 1983

[51] Int. Cl.[4] ..... F16L 3/22

[52] U.S. Cl. ..... 138/110; 166/241; 174/47

[58] Field of Search ..... 138/96 R, 110; 166/241; 174/47; 175/325; 308/4 A

[56] References Cited

U.S. PATENT DOCUMENTS

| | | | |
|---|---|---|---|
| 470,698 | 3/1892 | Murdock | 248/74.1 |
| 2,396,925 | 3/1946 | Morehouse | 248/68.1 |
| 2,858,093 | 10/1958 | Knoll | 174/47 |
| 3,171,889 | 3/1965 | McCarthy | 174/47 |
| 3,197,262 | 7/1965 | Fairchild | 308/4 A |
| 3,528,499 | 9/1970 | Collett | 166/175 |
| 3,740,801 | 6/1973 | Sears | 166/241 |
| 3,757,387 | 9/1973 | Bush | 166/241 |
| 4,266,578 | 5/1981 | Swain et al. | 138/110 |
| 4,422,504 | 12/1983 | Moore | 174/47 |

FOREIGN PATENT DOCUMENTS

| | | |
|---|---|---|
| 2017782 | 10/1979 | United Kingdom . |
| 2044320 | 10/1980 | United Kingdom . |
| 2101655 | 1/1983 | United Kingdom . |
| 2121091 | 12/1983 | United Kingdom . |

*Primary Examiner*—John W. Shepperd

*Attorney, Agent, or Firm*—John F. Booth; Gerald G. Crutsinger; Monty L. Ross

[57] ABSTRACT

A control line protector clamp having an elastic inner wall with longitudinal slots therein to accommodate and secure control lines comprising a pair of rubber-coated, semicylindrical, skeletal steel frame members hinged together along one of their longitudinal edges and adapted to be releasably closed securely into a generally cylindrical configuration by drive pin fastener means at their opposite longitudinal edges, the frame members each being of lateral, parallel, rib-and-slot construction with a reinforced, generally rectangular, three-walled, longitudinal channel formed in the member with the open side of the channel facing inwardly of the frame and encompassing the slots and with braces spanning the angles formed between the side walls of the channel and the circumference line of the frame members.

10 Claims, 5 Drawing Figures

PROTECTOR CLAMP FOR WELL CONTROL LINES

This invention relates to well control line protector stems and, more particularly, to apparatus for clamp-g tubing, cable or wires providing control signals to lownhole" valves and other equipment in wells to the ain well tubing or pipe.

ACKGROUND AND BRIEF DESCRIPTION OF THE INVENTION

In order to protect control line tubing cable or wires, well as to support their weight during insertion and moval of production pipe or tubing in oil wells or her types of wells, it has been found advantageous to amp the control lines tightly to the main production bing of the well.

Previous clamping devices for this purpose have ten been unsatisfactory either in not providing ade-ate holding power so that the control line is allowed cessive movement resulting in damage or in clamping e control lines so tightly as to cause crushing or other mage to the lines. Many of these clamps comprise a ged cylindrical metal framework molded within a bber coating and adapted to be closed around and cured in pressure contact to the production tubing of e well. In some of these types of clamps, grooves are ovided in the rubber interior wall of the clamp rough which the control lines pass. In others of these es of clamps, rubber "standoff" structures with nar-w neck or "keyhole" shaped slots are molded into the ter rubber wall. In the types with slots provided in e inner walls of the clamp, however, it has been found at the control lines are easily crushed when the clamp applied with sufficient pressure to prevent slippage of e clamp up and down or around the tubing. This is metimes because the walls of the grooves or slots are supported and tend to distort under pressure and cause the backwall of the groove receives direct in-ard pressure from the metal framework of the device the clamp is tightened. Even when the metal frame-ork is so constructed as to provide an offset around e slot area, the required clamping pressure may cause ch flexing of the metal frame that the control line is ll crushed or damaged. In the second type of struc-re, the clamp can be adequately tightened to prevent ppage on or around the tubing but the control lines e often not securely enough clamped and held in the ts to avoid damage under many likely circumstances.

The control line clamp of the present invention is of e type providing longitudinal slots or channels along interior walls to receive and hold the control lines. is protector clamp comprises a pair of rubber coated micylindrical laterally ribbed skeletal main elements ged together along one side and adapted on their her sides to receive a tapered pin in tapered inter-ved slots whereby the protector can be closed and easably clamped around the well tubing. One or both the semicylindrical main elements includes an offset gitudinal channel or groove formed intermediate the ge and latch edges and reinforcing braces connected ereto.

It is an object of the present invention to provide a ntrol line protector clamp adapted to affix control es firmly to well tubing without crushing or damag-g the control lines.

It is a further object to provide a control line protector clamp which may be quickly and easily but firmly attached to well tubing.

It is a still further object to provide a control line protector clamp for holding control lines closely adjacent well tubing while providing protection of the control lines from damage resulting from contact with the walls of the well casing or the bore tube.

BRIEF DESCRIPTION OF THE DRAWINGS

These and other objects and advantages of the present invention will become apparent from the following detailed description when read with reference to the accompanying drawings wherein.

DETAILED DESCRIPTION

Figure 2:
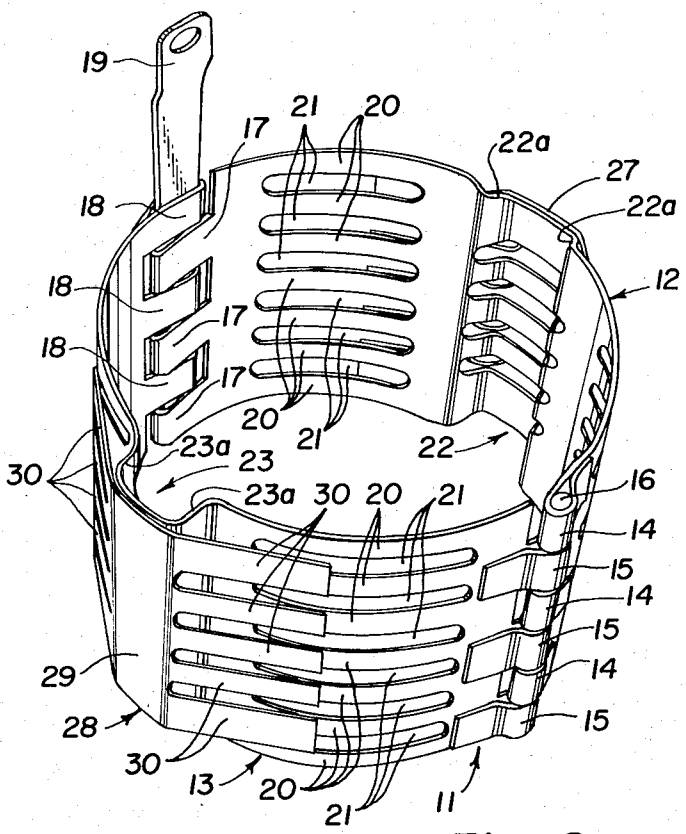
FIG. 2 is a view in perspective of the reinforced metal framework of the protector clamp of FIG. 1 prior to application of the rubber coating thereto.
Figure 1:
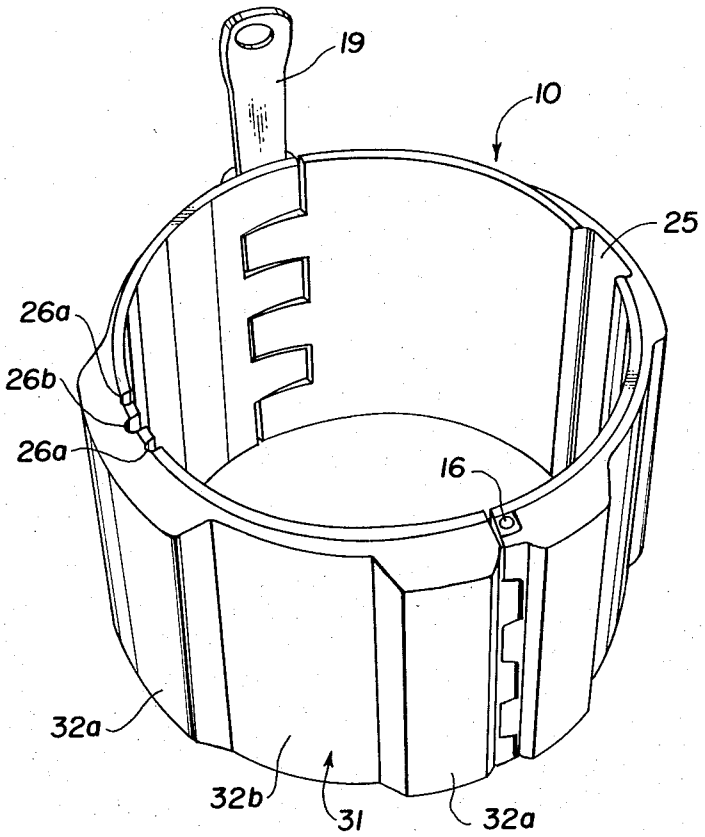
FIG. 1 is a view in perspective of one embodiment of the control line protector clamp of the present invention.
Figure 3:
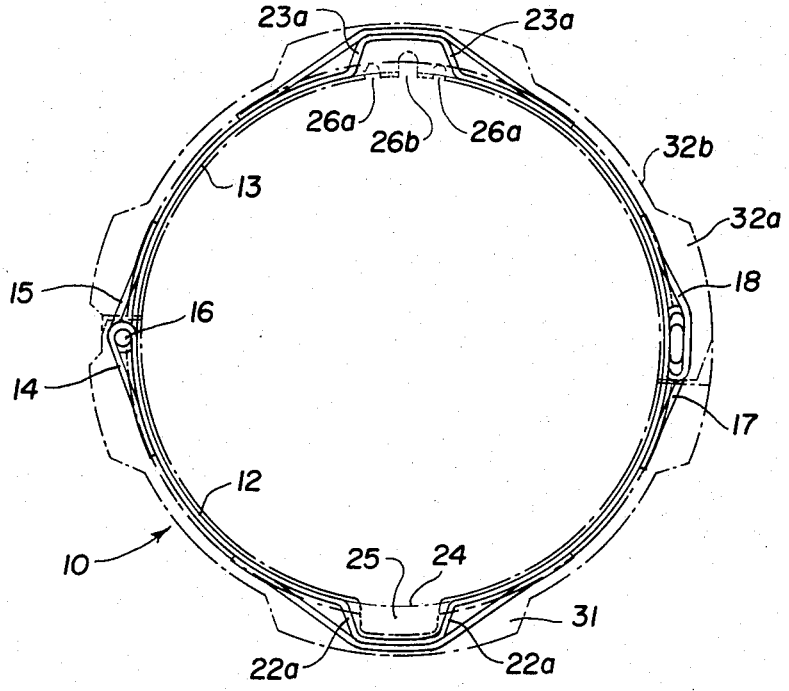
FIG. 3 is an end view of the control line protector clamp of FIG. 1 showing the positioning of the metal frame within the molded rubber coating.

Referring now to FIGS. 1–3, there is shown in FIG. 1 the hinged control line protector clamp 10 of the present invention. The protector clamp 10 comprises a cage-like skeletal metal frame 11 as shown in FIG. 2 comprising two semicylindrical frame members. Each frame member is formed from one of the main elements 12 or 13. Each main element 12 and 13 has formed along one vertical (longitudinal) edge a plurality of spaced hinge plates 14 and 15, respectively. Hinge plates 14 and 15 are formed to have bores therethrough adapted to receive a hingepin 16. Thus, when the two main elements are placed together with their hinge plates interleaved and the hingepin is inserted in the bores, a butt hinge is formed interconnecting the two main elements 12 and 13 and allowing pivotal movement therebetween.

Formed along the other vertical edge of each main element 12 and 13 are a series of spaced projections, 17 and 18, respectively. Projections 17 and 18 are shaped to interleave when the two main elements are placed together as shown in FIG. 2 and to form tapered holes adapted to receive a similarly tapered drive pin 19. When driven home in the tapered holes of the projections 17 and 18, drive pin 19 draws the hinged main elements tightly together to form a unitary cylindrical unit.

As best seen in FIG. 2, each of the semicylindrical main elements 12 and 13 is of a slotted or ribbed construction very much like the structure of the drill pipe protector unit frame of U.S. Pat. No. 4,266,578 of Jack W. Swain et al. assigned to the same assignee as the present invention. The ribs and slots 20 and 21 respectively of the skeletal frame 11 serve the purpose of enhancing the clamping effectiveness of the protector clamp 10 in the same manner as explained in the aforementioned patent.

Although main elements 12 and 13 are generally semicylindrical in shape, either or both are provided with an offset area forming a longitudinal generally rectangular channel 22 and 23, respectively. These offsets (which may be slotted as shown) provide a contoured metal framework for the rubber lined control line channel slots 25 and 26*a* and *b* in the completed protector clamp unit 10 (FIG. 1).

The presence of offset channels 22 and 23 would have a detrimental effect on the gripping or clamping of the protector clamp 10 because of flexing were it not for the channel braces 27 and 28, respectively. The braces 27 and 28 are of identical construction having a solid spine or midregion 29 and a plurality of fingers or rib-like portions 30 extending from either side of the spine 29 along its length. The spacing between the ribs 30 is essentially the same as the spacing between the ribs 20 of the main body of the frames. The channel braces are affixed to the main body of the frame along spine 29 and near the ends of each of the ribs 30 as by spot welding or other suitable means. Thus, the brace spans the outside angles between the side walls 22*a* and 23*a* of the channels 22 and 23 and the circumference line 24 of the frame 11 forming rigid triangular frameworks.

After each main element 12 or 13 is formed and assembled, a rubber coating 31 is applied and vulcanized to the frame member. This may be accomplished by a molding process or otherwise. FIG. 3 shows how the skeletal frame 11 is positioned within the rubber coating 31 (dashed lines) of the finished protector 10. The inside layer of rubber is of a substantially uniform thickness of approximately 1/16 inch (0.159 cm). The outside layer may be of an essentially uniform thickness of from about 1 inch (2.5 cm) or more to about $\frac{1}{4}$ inch (0.6 cm) or less depending on the overall size of the protector clamp. The protector clamps may ordinarly range from a nominal inside diameter of about 2 inches (5 cm) or less to about 7 inches (17.8 cm) or more. Often it is desirable to form the outside layer of rubber with lands 32*a* and grooves 32*b*, either straight as shown in FIG. 1 or spiraled. In such instances the lands 32*a* may be of the thicknesses mentioned above for the external layer and the grooves 32*b* may be formed down to a rubber coating thickness of from about $\frac{1}{8}$ inch (0.3 cm) or less to about $\frac{3}{8}$ inch (1 cm) or more.

Many known rubber compounds are suitable for the coating 31 such as those described in the aforementioned U.S. Pat. No. 4,266,578. Different rubber compounds may be used for the inside and outside layers or the layers may be the same compound.

Figure 4:
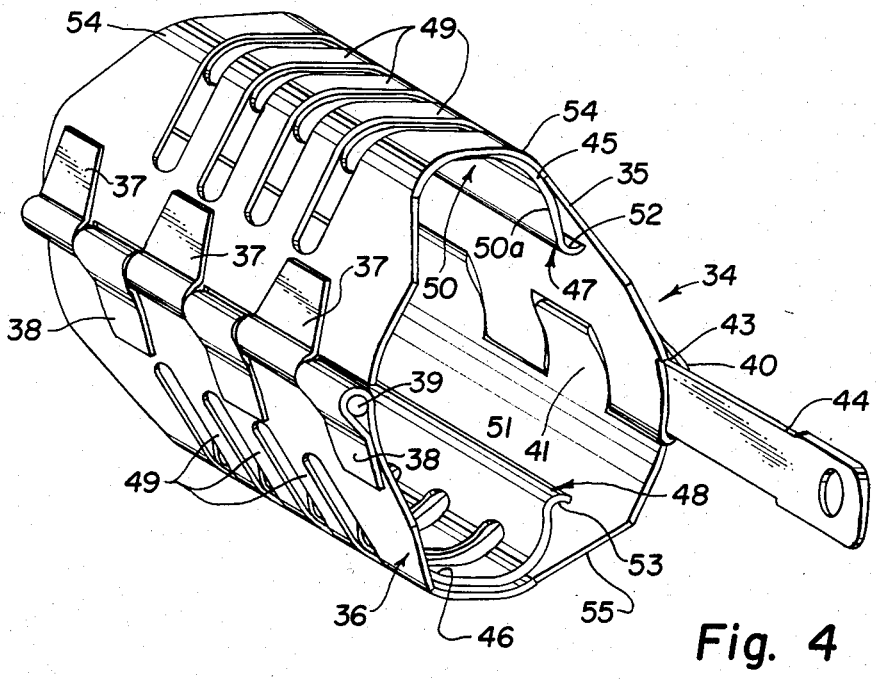
FIG. 4 is a view in perspective of a second embodiment of a metal frame for a control line protector clamp especially suitable for smaller diameter well tubing.

For a smaller protector clamp, a different type of channel and brace structure has been found to be desirable at times. Such a structure is illustrated in FIG. 4, a view in perspective of a smaller diameter skeletal frame 34. The frame 34, like the frame 11, comprises a pair of ribbed semicylindrical frame members. Each frame member is formed from one of the main elements 35 or 36. Each of the main elements 35 and 36 are formed with hinge plates 37 and 38 along longitudinal one edge. The hinge plates 37 and 38 together with hinge pin 39 provide a hinged connection between the two main elements. As in frame 11, the opposite longitudinal edges of the main elements 35 and 36 have a series of spaced projections 40 and 41 forming tapered holes 43 designed to receive a similarly tapered drive pin 44 to hold the protector clamp securely closed.

It will be noted that each of the main elements 35 and 36, rather than having a "double bend" offset configuration to form a rectangular walled channel as in frame 11, provide a "single bend" offset resulting in a somewhat oval shape without definite channel walls. In this smaller diameter embodiment of the protector clamp of the present invention, braces 45 and 46 are affixed to an inner surface of the half-frames and are configured to form the walled channels 50 and 51. Braces 45 and 46 are of essentially identical construction each having a pair of solid side regions or spines 47 and 48 connected by a plurality of ribs 49 extending between them. The outer edges 52 and 53 of each spine region 47 and 48 are "rolled" to add rigidity to the structure. The spine regions 47 and 48 and ribs 49 are attached to the half-frame as for example by spot welds or other means as shown.

Figure 5:
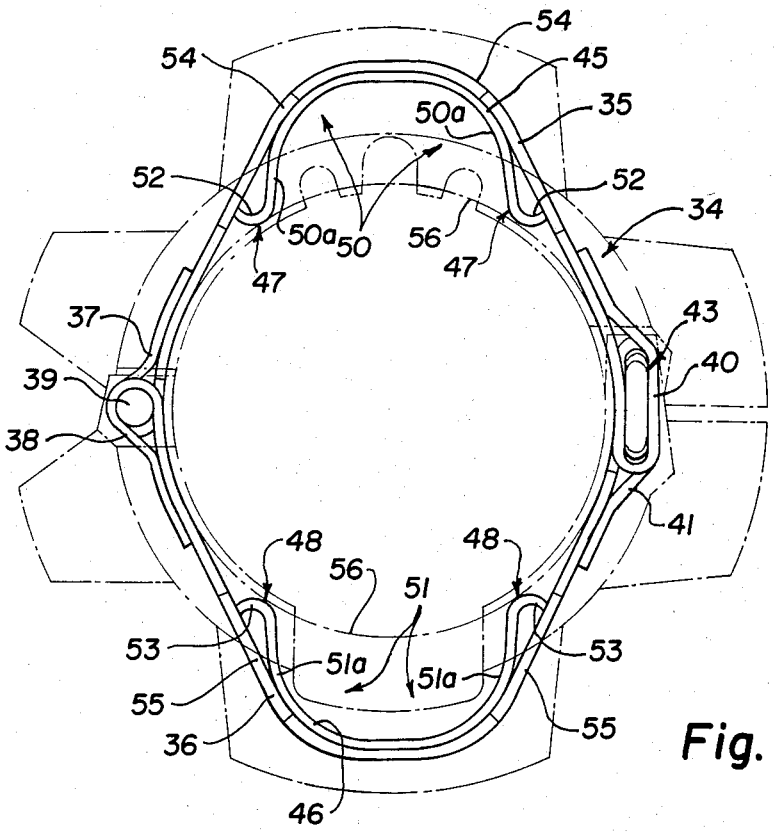
FIG. 5 is an end view of a completed protector clamp incorporating the frame of FIG. 4 and illustrating the position of the frame within the molded rubber coating.

Thus, in the embodiment of the protector frame illustrated in FIG. 5 of the walled channels 50 and 51 are formed by the braces 45 and 46. The "single bend" offset regions 54 and 55 of the main elements 35 and 36 then form the reinforcing element spanning the outside angles between the channel side walls 50*a* and 51*a* of the channels 50 and 51 and the circumference line 56 of the frame 34.

The main elements 12 and 13 and 35 and 36 may be made of any suitable metal, 4130 steel of a thickness of 0.050 inches (1.25 mm) with a tensile strength of 95,000 psi having been found satisfactory.

As with the protector clamp of FIGS. 1 and 3, the clamp of FIG. 5 is completed by vulcanizing a molded rubber coating to each of the frames members of FIG. 4 and inserting the hinge pin 39. Tapered drive pin 44 is, of course, inserted in the clamp to maintain the protector clamp and control lines firmly affixed to the well tubing after they have been positioned thereon.

As shown in FIG. 5, the finished clamp has a reltively thin coating of rubber on its inner wall and a relatively thick outer wall solid or ribbed coating of rubber. The inner wall coating may be of a thickness of approximately 1/16 inch (0.159 cm). The outer wall coating may appropriately be from about $\frac{1}{4}$ inch (0.6 cm) to about 1 inch (2.5 cm). For the embodiment in which the outer rubber coating is grooved, the lands of the coating may be in approximately the same ranges of thickness as those of the solid outer wall coating with the coating at the base of the groove being between about $\frac{1}{8}$ and $\frac{3}{8}$ inches (0.3 and 1 cm).

The longitudinal channels 22 and 23 and 50 and 51 formed by the frames are typically about $\frac{1}{8}$ inch wider and about 1/16 inch deeper than the actual cable size. In the finished rubber coated protector the channel slots such as 25 are provided to the actual control line size, typically about $1\frac{1}{8}$ inches (2.85 cm) wide by about 7/16 inch (1.1. cm) deep. Although each half of the protector clamp may be provided with channel slots of a size appropriate for larger control lines, it is often desirable to provide one or more small line or single wire slot channels such as those designated 26*a* and 26*b*. These smaller slot channels may typically be from $\frac{1}{4}$ inch (0.6 cm) to $\frac{3}{8}$ inch (0.95 cm) wide and from about $\frac{1}{4}$ inch (0.6 cm) to about $\frac{3}{8}$ inch (0.95 cm) deep.

The protector clamp of the present invention provides protection for control lines to "downhole" equipment far superior to that provided by prior art protectors. This superior protection is achieved because of the unique reinforced channel structure of the protector clamp fame member. Whether the channel slot is formed in the main elements 12 and 13 and reinforced by the braces 27 and 28 or the slot channel is formed in braces 45 and 46 affixed to an offset in the main elements 35 and 36, the result is the same. The braces span the outside angles between the channel side walls to form the hypotenuses of rigid triangular frames which essentially eliminate flexing, bending or distortion of the channels and slots which would otherwise result if the protectors were clamped too tightly around the well tubing. The reinforced structure of the present invention not only protects the control lines from crushing or damage because of flexing or distortion of the channels and slots, but because the protector clamp can be more securely clamped to the wall tubing, prevents damage and distortion of the control lines due to slipping and/or turning of the clamps themselves on the tubing.

Thus, there has been disclosed a control line protector clamp providing improved control line protection through the use of a frame structure having a reinforced channel slot construction.

Many changes and modifications still within the scope and spirit of the teachings of the foregoing disclosure of specific embodiments will become apparent to those skilled in the art and thus it is intended that all such variations be deemed within the scope of the following claims.

What is claimed is:

1. A control line protector clamp having an elastic inner wall with at least one longitudinal slot therein to accommodate and secure control lines comprising: a pair of semicylindrical skeletal frame members coated with resilient material and connected together along one of their longitudinal edges and adapted to be releasably closed securely into a generally cylindrical configuration by fixing fastener means at their opposite longitudinal edges, at least one of said frame members comprising a generally semicylindrical main element and a brace, said main element being of lateral, parallel, rib-and-slot construction and a generally rectangular, three-walled, longitudinal channel formed along said main element with the open side of said channel facing inwardly of said frame member to encompass said slot and said brace being fixed with the ends and central area of the brace attached to the main element to form a triangular structure to resist collapse of said channel.

2. The control line protector clamp of claim 1 wherein said frame members are of steel.

3. A control line protector clamp having an elastic inner wall with at least one longitudinal slot to accommodate and secure control lines comprising: a pair of semicylindrical, skeletal frame members coated with resilient material each frame member having a main element and a brace fixed to said main element, said main elements having a generally semicylindrical shape and being hinged together along one of their longitudinal edges and adapted to be closed into a generally cylindrical configuration by inserting a tapered drive pin member through a plurality of interleaved tapered slots formed at their opposite longitudinal edges, said main elements being of lateral parallel rib-and-slot construction, each of said main elements having a generally rectangular three-walled, longitudinal channel formed therein intermediate said longitudinal edges with the open side of said channel facing inwardly and encompassing said longitudinal slot, said brace being affixed to said main element on and along the bottom wall of said channel and on the outward side of said main element with the braces fixed with the ends and central area of the brace attached to the main element to form a triangular structure to resist collapse of said channel.

4. The control line protector clamp of claim 3 wherein said frame members are of steel.

5. A control line protector clamp having an elastic inner wall with at least one longitudinal slot to accommodate and secure control lines comprising: a pair of semicylindrical skeletal frame members coated with resilient material, each formed of a main element and a brace fixed together, said main elements having a semicylindrical shape and being hinged together along one of their longitudinal edges and adapted to be closed into a generally cylindrical configuration by inserting a tapered drive pin member through a plurality of interleaved tapered slots formed at the opposite longitudinal edges of said main elements, said main elements being of lateral, parallel rib-and-slot construction, each brace having a generally rectangular, three-walled, longitudinal channel formed therein, the longitudinally extending edges of said brace being turned whereby the opposite edges of said braces extend away from said slot, said brace being affixed to the internal wall of the main element with the open side of said channel facing inwardly of said frame member and encompassing said slot whereby said main element extends across the outward angles between said channel side walls and the circumference line of said main elements and abuts against the longitudinally extending turned edges of said brace to form a triangular structure to resist collapse of said channel.

6. The control line protector clamp of claim 5 wherein said frame members are of steel.

7. The protector of claim 5 where said longitudinally extending turned edges are rolled.

8. In a clamp for connecting a control line or the like to a tubular member the clamp having an elastic inner wall with at least one longitudinal slot therein to accommodate and receive control lines, said clamp having at least one cylindrically extending skeletal frame member coated with resilient material and a releasable fastener means operably connected thereto for releasably attaching said frame extending around a portion of the exterior of said tubular member, said frame member comprising a cylindrically extending main element, the improvement which comprises said frame member additionally comprising a brace and a generally rectangular, three-walled, longitudinal channel formed in the innermost one of said main element and said brace with the open side of said channel facing inwardly to encompass said slot and said brace being affixed along its ends and central area to said main element thereby forming triangular structures adjacent the channel to resist collapse of said channel.

9. In a clamp for connecting a control line or the like to a tubular member the clamp having an elastic inner wall with at least one longitudinal slot therein to accommodate and receive control lines therein, said clamp having at least one cylindrically extending skeletal frame member coated with resilient material and a releasable fastener means operably connected thereto for releasably attaching said frame member extending around a portion of the exterior of said tubular member, said frame member comprising a cylindrically extending main element, the improvement which comprises said frame member additionally comprising a brace and a generally rectangular, three-walled, longitudinal channel formed in said brace with the open side of said channel facing inwardly to encompass said slot and said brace being affixed along its central area to said main element with its ends abutting said main element and forming with said main element triangular structures adjacent the channel to resist collapse of said channel.

10. In a clamp for connecting a control line or the like to a tubular member the clamp having an elastic inner wall with at least one longitudinal slot therein to accommodate and receive control lines, said clamp having at least one cylindrically extending skeletal frame member coated with resilient material and a releasable fastener means operably connected thereto for releasably attaching said frame member extending around a portion of the exterior of said tubular member, said frame member comprising a cylindrically extending main element, the improvement which comprises said frame member additionally comprising a brace and a generally rectangular, three-walled, longitudinal channel formed in said main element with the open side of said channel facing inwardly to encompass said slot and said brace being affixed to said main element with the ends and central area of the brace attached to the main element to form triangular structures adjacent the channel to resist collapse of said channel.

* * * * *